US010508331B2

(12) United States Patent
Kita

(10) Patent No.: US 10,508,331 B2
(45) Date of Patent: Dec. 17, 2019

(54) METHOD FOR MANUFACTURING FERRITIC STAINLESS STEEL PRODUCT

(71) Applicant: DENSO CORPORATION, Kariya, Aichi-pref. (JP)

(72) Inventor: Takuya Kita, Kariya (JP)

(73) Assignee: DENSO CORPORATION, Kariya, Aichi-pref. (JP)

( * ) Notice: Subject to any disclaimer, the term of this patent is extended or adjusted under 35 U.S.C. 154(b) by 0 days.

(21) Appl. No.: 16/294,016

(22) Filed: Mar. 6, 2019

(65) Prior Publication Data

US 2019/0203331 A1 Jul. 4, 2019

Related U.S. Application Data

(63) Continuation of application No. PCT/JP2017/032412, filed on Sep. 8, 2017.

(30) Foreign Application Priority Data

Sep. 12, 2016 (JP) ..... 2016-177568

(51) Int. Cl.

| | |
|---|---|
| ***C23C 8/34*** | (2006.01) |
| ***C21D 1/76*** | (2006.01) |
| ***C21D 6/00*** | (2006.01) |
| ***C23C 8/22*** | (2006.01) |
| ***C23C 8/26*** | (2006.01) |
| ***C23C 8/38*** | (2006.01) |
| ***C23C 8/80*** | (2006.01) |

(Continued)

(52) U.S. Cl.

CPC ..... *C23C 8/34* (2013.01); *C21D 1/06* (2013.01); *C21D 1/18* (2013.01); *C21D 1/76* (2013.01); *C21D 6/00* (2013.01); *C23C 8/22* (2013.01); *C23C 8/26* (2013.01); *C23C 8/38* (2013.01); *C23C 8/80* (2013.01); *C21D 2211/005* (2013.01)

(58) Field of Classification Search

CPC ..... C23C 8/34; C23C 8/22

See application file for complete search history.

(56) References Cited

U.S. PATENT DOCUMENTS

| | | | | |
|---|---|---|---|---|
| 2004/0250921 | A1* | 12/2004 | Yamaguchi | C23C 8/30 148/218 |
| 2007/0186999 | A1 | 8/2007 | Kuroda et al. | |
| 2014/0283955 | A1 | 9/2014 | Watanabe et al. | |

FOREIGN PATENT DOCUMENTS

| | | | |
|---|---|---|---|
| JP | S59107028 | A | 6/1984 |
| JP | 2002180235 | A | 6/2002 |

(Continued)

OTHER PUBLICATIONS

Takeshi Naito, "Shintan Yakiire no Jissai 2nd edition—Gas Shintan to Zairyo Kyokaho-", 2nd edition, 1st print, The Nikkan Kogyo Shinbun, Ltd., Feb. 26, 1999 (Feb. 26, 1999), p. 4 to 5, 81 to 82.

*Primary Examiner* — Jessee R Roe

(74) *Attorney, Agent, or Firm* — Harness, Dickey & Pierce, P.L.C.

(57) ABSTRACT

A method for manufacturing a ferritic stainless steel product includes forming a carburized layer on a workpiece made of ferritic stainless steel, and forming a nitrided layer on a surface of the workpiece by heating the workpiece at a temperature equal to or higher than a transformation point of the ferritic stainless steel in an atmosphere containing an $N_2$ gas.

5 Claims, 9 Drawing Sheets

(51) Int. Cl.
*C21D 1/06* (2006.01)
*C21D 1/18* (2006.01)

(56) References Cited

FOREIGN PATENT DOCUMENTS

| | | | |
|---|---|---|---|
| JP | 2006316338 | A | 11/2006 |
| JP | 2014181397 | A | 9/2014 |
| JP | 2015067876 | A | 4/2015 |

* cited by examiner

METHOD FOR MANUFACTURING FERRITIC STAINLESS STEEL PRODUCT

CROSS REFERENCE TO RELATED APPLICATIONS

The present application is a continuation application of International Patent Application No. PCT/JP2017/032412 filed on Sep. 8, 2017, which designated the United States and claims the benefit of priority from Japanese Patent Application No. 2016-177568 filed on Sep. 12, 2016. The entire disclosures of all of the above applications are incorporated herein by reference.

TECHNICAL FIELD

The present disclosure relates to a method for manufacturing a ferritic stainless steel product.

BACKGROUND

Conventionally, a surface modification method of stainless steel has been investigated. For example, a nitriding method has been known in which ferritic stainless steel is heated at a nitriding temperature in an inert atmosphere containing nitrogen gas.

SUMMARY

The present disclosure provides a method for manufacturing a ferritic stainless steel product. The method includes forming a carburized layer on a workpiece made of ferritic stainless steel, and forming a nitrided layer on a surface of the workpiece by heating the workpiece at a temperature equal to or higher than a transformation point of the ferritic stainless steel in an atmosphere containing an $N_2$ gas.

BRIEF DESCRIPTION OF THE DRAWINGS

The above and other objects, features and advantages of the present disclosure will become more apparent from the following detailed description made with reference to the accompanying drawings in which.

DETAILED DESCRIPTION

For example, a nitrided layer may be formed on a surface of a ferritic stainless steel workpiece at a temperature lower than 1100 degrees Celsius (° C.) in a heating furnace whose inner wall is covered with carbon in order to stably form a nitrided layer.

However, in this method for forming a nitrided layer, a nitrided layer may not be sufficiently formed on a workpiece having a low carbon concentration. That is, in order to form a sufficient nitrided layer, a workpiece to be processed is limited. If the nitrided layer cannot be sufficiently formed, a martensite phase cannot be sufficiently formed, and hardness cannot be sufficiently improved by modifying the ferritic stainless steel.

(First Embodiment)

Embodiments of a method for manufacturing a ferritic stainless steel product will be described with reference to the drawings. In manufacturing the ferritic stainless steel product, the following carburizing step and the nitriding step are performed.

Figure 1A:
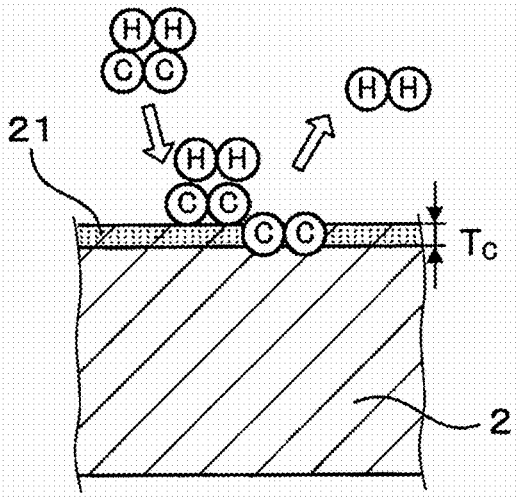
FIG. 1A is an illustrative cross-sectional view of a workpiece in a carburizing step according to a first embodiment.
Figure 1B:
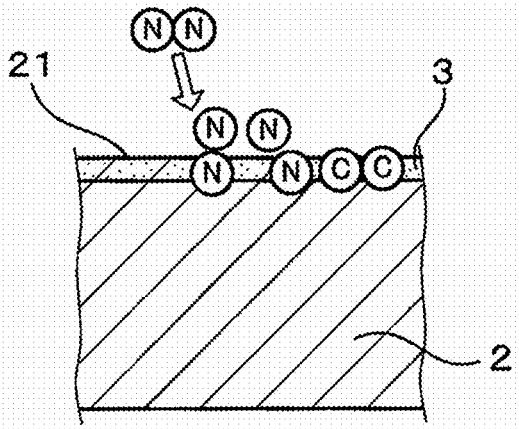
FIG. 1B is an illustrative cross-sectional view of the workpiece in an initial stage of a nitriding step according to the first embodiment.
Figure 1C:
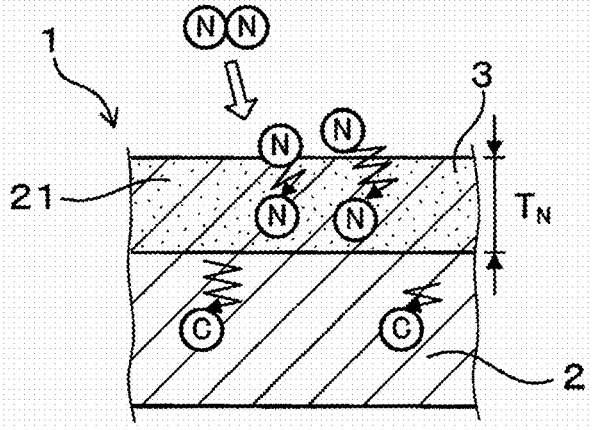
FIG. 1C is an illustrative cross-sectional view of the workpiece in a diffusion stage of a carburized layer and a formation progress stage of a nitrided layer in a nitriding step according to the first embodiment.

As illustrated in FIG. 1A, in the carburizing step, a carburized layer 21 is formed on a workpiece 2 made of ferritic stainless steel. As illustrated in FIGS. 1B and 1C, in the nitriding step, the workpiece 2 is heated in an atmosphere containing an $N_2$ gas at a temperature equal to or higher than a transformation point of the ferritic stainless steel. As a result, a nitrided layer 3 is formed on a surface of the workpiece. Hereinafter, a detailed description will be given.

As the workpiece 2 made of ferritic stainless steel, there is no particular limitation as long as the workpiece 2 is ferritic stainless steel, and various compositions can be used. The ferritic stainless steel material in the workpiece preferably has a carbon content of 0.3 mass % or less. In this case, a corrosion resistance is further improved. From the viewpoint of further enhancing the above effect, the carbon content of the ferritic stainless steel material is more preferably 0.12 mass % or less, and further preferably 0.01 mass % or less.

The carburizing step and the nitriding step can be performed, for example, in a heating furnace 4 as exemplified in FIG. 3 in a second embodiment which will be described later. As the heating furnace 4, for example, a batch type or a continuous type furnace can be used.

The carburized layer 21 can be formed in the carburizing step by, for example, gas carburizing, vacuum carburizing, or plasma carburizing. In those carburizing processes, carburizing gas can be used.

As the carburizing gas, a hydrocarbon gas such as a saturated hydrocarbon gas or an unsaturated hydrocarbon gas can be used. Preferably, an unsaturated hydrocarbon gas such as acetylene is used. In this case, a passive film present on the surface of the ferritic stainless steel is more easily broken, and the reactivity with the workpiece can be improved. As the carburizing gas, the above-mentioned hydrocarbon gas can be used alone, or a mixed gas of a hydrocarbon gas and, for example, an inert gas can be used.

As illustrated in FIG. 1A, the formation of the carburized layer 21 is preferably performed by vacuum carburizing. In this case, a carburizing gas is easily taken into the workpiece 2 made of ferritic stainless steel. In addition, since a special device such as a plasma generation device is not required for a carburizing process, carburizing can be performed at low cost.

As illustrated in FIGS. 1B and 1C, in the nitriding step, the workpiece 2 is heated in an atmosphere containing an $N_2$ gas at a temperature equal to or higher than a transformation point of the ferritic stainless steel. As a result, the nitrided layer 3 is formed on the surface of the workpiece 2. Hereinafter, a heating temperature in the nitriding step is referred to as an appropriate nitriding temperature.

The atmosphere containing the $N_2$ gas may contain at least $N_2$, and may further contain an inert gas. The atmosphere in the nitriding step may contain the carburizing gas remaining in the carburizing step. The amount of residual carburizing gas is preferably small. Preferably, the atmosphere containing the $N_2$ gas is the $N_2$ gas.

The transformation point is a temperature at which at least a part of a ferrite phase in a ferritic stainless steel material is transformed into an austenite phase. The transformation point differs depending on the composition of the material, but is, for example, 700 to 900° C.

The nitriding temperature is preferably 900° C. or higher, which is a decomposition temperature of nitrogen. In this case, the solid solution of nitrogen in the workpiece 2 is more likely to occur. In light of easier solid solution of nitrogen, the nitriding temperature is more preferably 1000° C. or higher, and more preferably 1050° C. or higher.

The nitriding temperature is preferably 1100° C. or less. In this case, coarsening of crystal grains in the workpiece can be reduced and a decrease in strength can be reduced. From the viewpoint of further reducing coarsening of the crystal grains, the nitriding temperature is more preferably 1050° C. or less.

Figure 2:
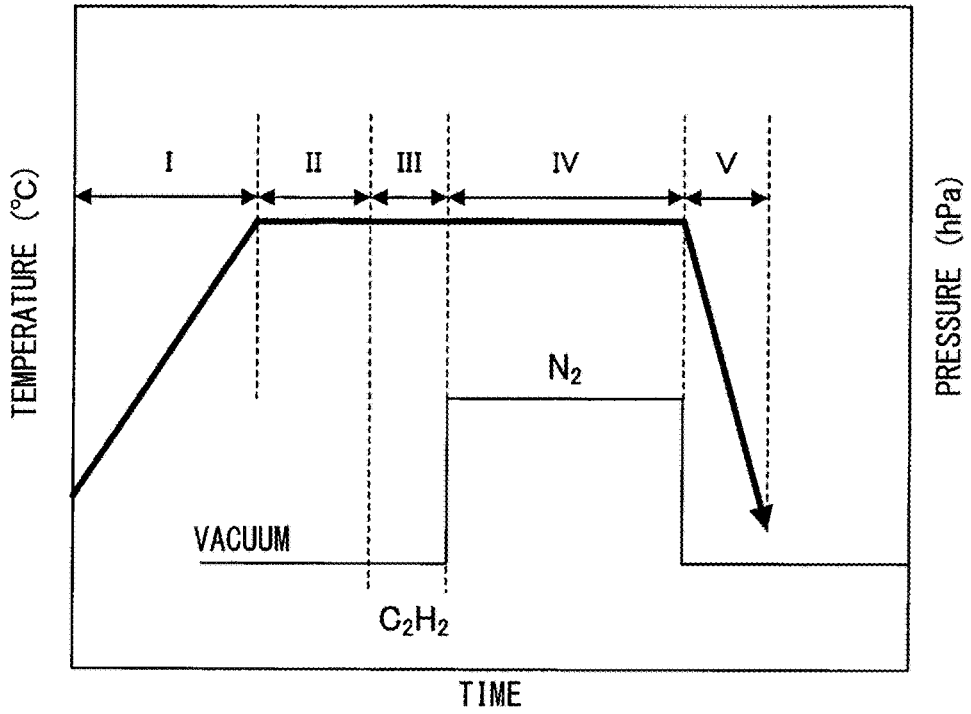
FIG. 2 is a diagram showing a relationship between a time, a temperature change, and a pressure change in manufacturing of a ferritic stainless steel product according to the first embodiment.

As shown in FIG. 2, the carburizing step and the nitriding step are performed by a temperature increasing step (I), a heat soaking step (II), a carburizing gas introducing step (III), and a high-temperature nitriding step (IV), which will be described below, and further, a cooling step (V) for quenching the workpiece 2 after the nitriding step can be performed. In FIG. 2, a horizontal axis represents a time, a left vertical axis represents a temperature, and a right vertical axis represents a pressure. In FIG. 2, a thick line indicates a temperature change, and a thin line indicates a pressure change.

In the temperature increasing step (I) and the heat soaking step (II), for example, the inside of the heating furnace in which the workpiece 2 is installed is increased in temperature to the carburizing temperature and held. The carburizing temperature can be appropriately determined, and is, for example, 1000 to 1100° C. FIG. 2 shows a case where the carburizing temperature and the nitriding temperature are the same as each other, but the carburizing temperature and the nitriding temperature may be different from each other.

In the carburizing gas introducing step (III), carburizing gas is supplied into, for example, a heating furnace in which the workpiece 2 is installed. As a result, the carburizing step of forming the carburized layer 21 on the workpiece 2 can be performed. An introduction time of the carburizing gas can be appropriately determined. The carburizing gas introduction time and the carburizing temperature may be appropriately determined so that, for example, a surface carbon concentration $X_C$ and a thickness $L_C$ of the carburized layer 21 shown in Experimental Example 2, which will be described later, have a desired relationship.

As illustrated in FIG. 1B, FIG. 1C, and FIG. 2, in the high-temperature nitriding step (IV), the $N_2$ gas or the gas containing the $N_2$ gas is supplied into the heating furnace at the nitriding temperature. As a result, the nitrided layer 3 can be formed on the workpiece 2. The nitriding temperature and the nitriding time can be appropriately determined in accordance with the hardness required for the workpiece. The nitriding temperature and the nitriding time may be appropriately determined so that, for example, the surface carbon concentration $X_C$ after the carburizing step to be described later, the thickness $L_C$ of the carburized layer 21 after the carburizing step, and a thickness $L_N$ of the carburized layer 21 after the nitriding step have a desired relationship.

As illustrated in FIG. 2, in the cooling step (V), the temperature in the heating furnace in which the workpiece 2 is installed is lowered from the nitriding temperature to a predetermined temperature. In the cooling step (V), it is preferable to quench the workpiece 2 having the nitrided layer 3. In that case, a martensite phase having a high hardness can be formed more reliably and sufficiently in the nitrided layer 3 by quenching. The quenching can be performed by quenching the workpiece 2 by, for example, oil cooling.

After the cooling step, it is preferable to perform a sub-zero process for cooling the workpiece 2 to a low temperature of, for example, 0° C. or less. The sub-zero process is also called a deep cooling process. With the above process, the residual austenite phase in the material of the workpiece 2 can be martensitized.

After the sub-zero process, tempering is preferably performed. In that case, the unstable structure inside the material can be stabilized.

In the present embodiment, the nitriding step is performed after the carburizing step as described above. As illustrated in FIG. 1A, the formation of the carburized layer 21 in the carburizing step can break the passive film existing on the surface of the ferritic stainless steel of the workpiece 2. For that reason, in the nitriding step performed after the carburizing step, as illustrated in FIG. 1B, nitrogen easily dissolves in the ferritic stainless steel of the workpiece 2. Therefore, as illustrated in FIG. 1C, the nitrided layer 3 can be sufficiently formed, and the nitrided layer 3 can be formed from the surface of the workpiece 2 to a sufficiently deep portion.

The nitrided layer 3 can cause martensitic transformation by, for example, cooling, and can form a martensite phase having excellent hardness. Therefore, according to the manufacturing method of the present embodiment, the ferritic stainless steel product 1 having high hardness can be manufactured.

In the nitriding step, as described above, after the formation of the carburized layer 21, heating is performed at a high temperature, which is equal to or higher than the transformation point temperature of the ferritic stainless steel. For that reason, in the nitriding step, carbon atoms in the carburized layer 21 can be diffused into the interior of the workpiece 2. In other words, in the nitriding step, not only the solid solution of nitrogen into the carburized layer 21 and the formation of the nitrided layer 3 but also the diffusion of carbon atoms can lower the surface carbon concentration of the workpiece 2. This decrease in the surface carbon concentration makes it possible to improve the corrosion resistance. Therefore, the ferritic stainless steel product 1 having excellent corrosion resistance can be manufactured.

As described above, with the execution of the nitriding step after the carburizing step, the ferritic stainless steel product 1 having the excellent corrosion resistance and the high hardness can be obtained. The ferritic stainless steel product 1 can be used for various applications requiring the corrosion resistance and the hardness. Examples include automobile engine control components, fuel system components, and exhaust system components.

(Second Embodiment)

Figure 3:
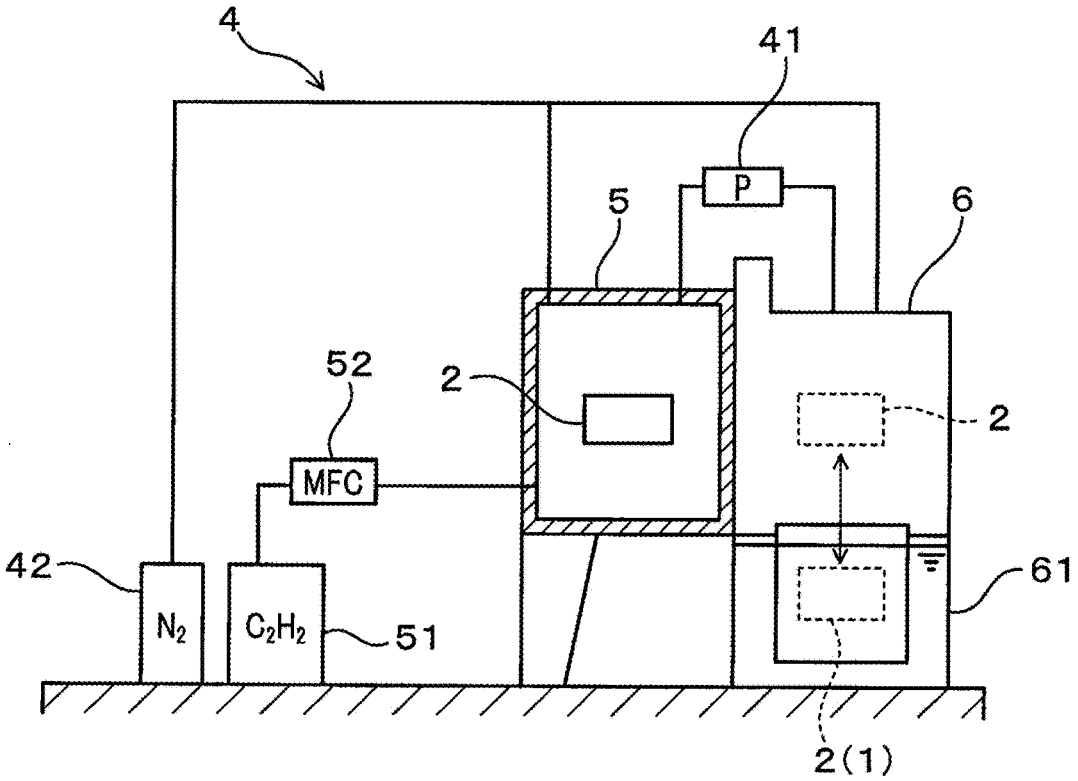
FIG. 3 is a schematic diagram of a heating furnace according to a second embodiment.

The present embodiment is an example of manufacturing a disk-shaped ferritic stainless steel product 1 by performing a carburizing step and a nitriding step using a heating furnace 4 illustrated in FIG. 3. Incidentally, among reference numerals used in the second and subsequent embodiments, the same reference numerals as those used in the embodiment already described represent the same components as those in the embodiment already described, unless otherwise indicated.

As illustrated in FIG. 3, a heating furnace 4 includes a carbonitriding chamber 5 and a cooling chamber 6. The carbonitriding chamber 5 is provided with a heater (not shown), and an interior of the carbonitriding chamber 5 is heated by the heater. The cooling chamber 6 includes an oil tank 61 for cooling and a lifting device (not shown), and a workpiece 2 on which a carburized layer 21 and a nitrided layer 3 are formed, that is, a ferritic stainless steel product 1, is moved into and out of an oil tank 61 by the lifting device.

A vacuum pump (P) 41 and a nitrogen gas cylinder 42 capable of pressurizing a nitrogen gas to an atmospheric pressure or higher are connected to both of the carbonitriding chamber 5 and the cooling chamber 6. A carburizing gas cylinder 51 containing at least a carburizing gas such as acetylene gas is connected to the carbonitriding chamber 5 through a mass flow controller 52. The mass flow controller is hereinafter referred to as MFC as appropriate. The heating furnace 4 is provided with a transport device capable of moving the ferritic stainless steel product 1 between the carbonitriding chamber 5 and the cooling chamber 6. In FIG. 2, illustration of the transport device is omitted.

In manufacturing the ferritic stainless steel product 1 using the heating furnace 4 according to the present embodiment, first, a disk-shaped workpiece 2 made of ferritic stainless steel and having a diameter Φ of 15 mm and a thickness of 2 mm is disposed in the carbonitriding chamber 5.

Next, the temperature rise in the carbonitriding chamber 5 is started by the heater (not shown). Then, the temperature in the carbonitriding chamber 5 is raised to, for example, the carburizing temperature of 1050° C. Next, while maintaining at this carburizing temperature for 10 minutes (heat soaking step), the inside of the carbonitriding chamber 5 is depressurized to a vacuum state by drawing a vacuum with the vacuum pump 41.

Next, acetylene gas is introduced into the carbonitriding chamber 5 as the carburizing gas from the carburizing gas cylinder 51 at a predetermined flow rate while adjusting the MFC 52 (carburizing gas introducing step). In the present embodiment, the carburizing gas was introduced for 1 minute. As a result, the carburized layer 21 is formed on the workpiece 2. From the viewpoint of improving productivity by shortening a formation time of the carburized layer 21, an introduction time of the carburizing gas is preferably 5 minutes or less, more preferably 3 minutes or less, and still more preferably 2 minutes or less.

Next, the nitrogen gas is introduced into the carbonitriding chamber 5 from the nitrogen gas cylinder 42, and the interior of the carbonitriding chamber 5 is maintained at the above-mentioned temperature of 1050° C. for another 120 minutes (high-temperature nitriding step). As a result, nitrogen is dissolved in a solid solution in the workpiece on which the carburized layer 21 is formed, and the nitrided layer 3 is formed. Further, in the high-temperature nitriding step, carbon in the carburized layer 21 diffuses from the surface side to the inside side of the workpiece 2.

Next, the heater is stopped, and the ferritic stainless steel product 1 on which the carburized layer 21 and the nitrided layer 31 are formed is transported from the nitriding chamber 5 to the cooling chamber 6 by the transport device (not shown). Further, in the cooling chamber 6, the ferritic stainless steel product 1 is immersed in the oil tank 61 by the lifting device (not shown) to perform the oil cooling. With the above oil cooling, martensitic transformation occurs in the nitrided layer 3 of the ferritic stainless steel, and a martensite phase is formed. After cooling the oil, the ferrite steel stainless steel product 1 is pulled up from the oil tank by the lifting device.

Next, after the sub-zero process has been performed, tempering process is performed to obtain the ferritic stainless steel product 1 of the present embodiment. The ferritic stainless steel product 1 thus obtained has both of the excellent corrosion resistance and the excellent hardness as shown in Experimental Example 1 to be described later.

(Experimental Example 1)

In this example, the corrosion resistance and the hardness of a ferritic stainless steel product (that is, an example product) produced by performing the nitriding step after the carburizing step and a ferritic stainless steel product (that is, a comparative example product) produced by performing the nitriding step without performing the carburizing step are evaluated. The example product is a ferritic stainless steel product produced in the same manner as in second embodiment described above. The comparative example product is the ferritic stainless steel product produced in the same manner as in second embodiment except that acetylene gas is not introduced.

<Evaluation on Corrosion Resistance>

Figure 4A:
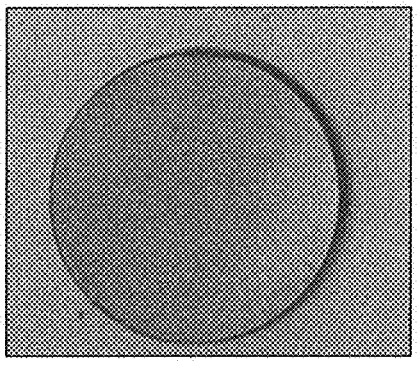
FIG. 4A is a photograph showing a surface of an example product after a corrosion resistance evaluation test in Experimental Example 1.
Figure 4B:
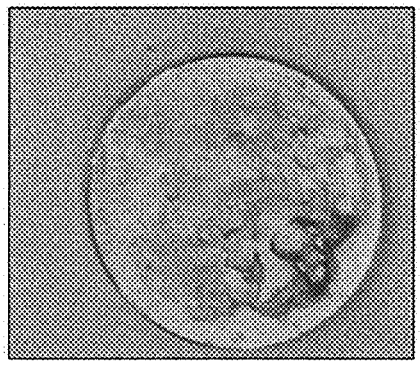
FIG. 4B is a photograph showing a surface of a comparative example product after a corrosion resistance evaluation test in Experimental Example 1.

A neutral salt spray test is conducted in accordance with JIS Z2371: 2000 to evaluate the corrosion resistance of the example product and the comparative example product. The spraying of the brine is carried out continuously. After the test, the presence or absence of discoloration of the surface is visually observed. The results of the example product are shown in FIG. 4A and the results of the comparative example product are shown in FIG. 4B.

<Hardness Evaluation>

(1) Cross-Sectional Texture Observation

Figure 5A:
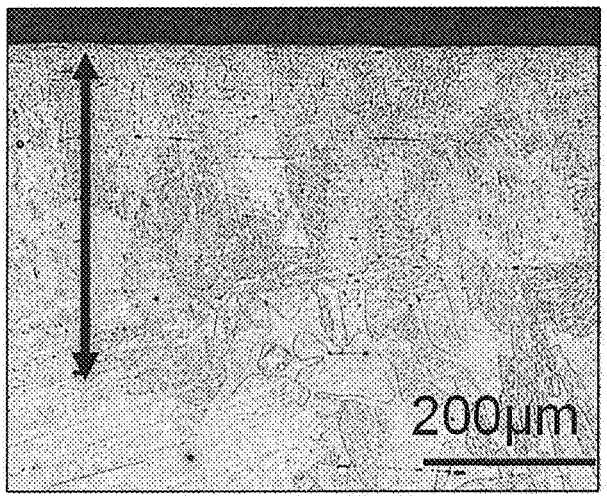
FIG. 5A is a photograph showing a cross-sectional texture of the example product in Experimental Example 1.
Figure 5B:
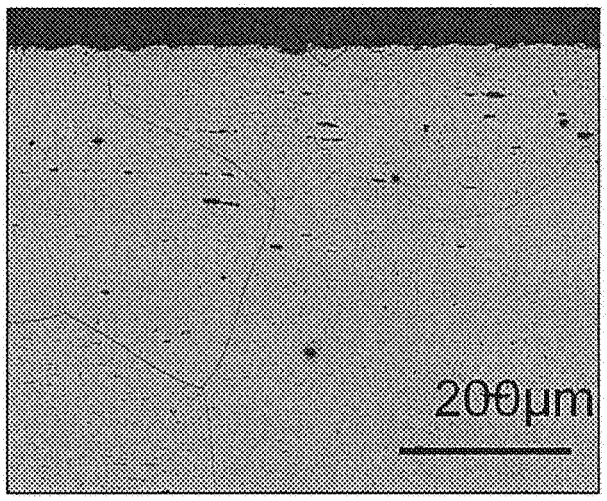
FIG. 5B is a photograph showing a cross-sectional texture of the comparative example product in Experimental Example 1.

The disk-shaped example product and the disk-shaped comparative example product are cut so as to be bisected in a diameter direction, and the cross-sectional texture of those cut products is observed with an optical microscope at a magnification of 100-fold. A cross-sectional texture photograph of the example product is shown in FIG. 5A, and a cross-sectional texture photograph of the comparative example product is shown in FIG. 5B. Arrows in FIG. 5A indicate an area in which the martensite phase is formed in an entire region at a predetermined depth from the surface.

(2) Measurement of Vickers Hardness

Figure 6A:
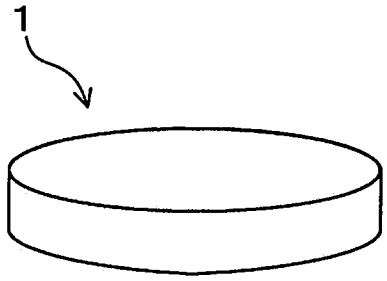
FIG. 6A is a perspective view of a disk-shaped ferritic stainless steel product in Experimental Example 1.
Figure 6B:
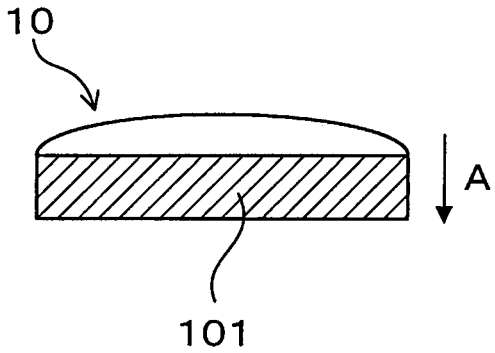
FIG. 6B is a perspective view of a bisected ferritic stainless steel product in Experimental Example 1.
Figure 7:
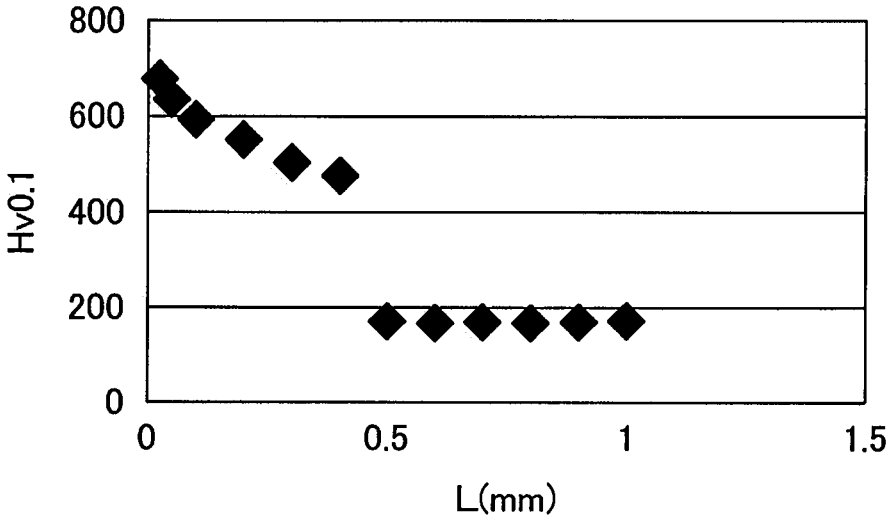
FIG. 7 is an illustrative diagram showing a relationship between a distance from the surface of the example product and Vickers hardness in Experimental Example 1.
Figure 8:
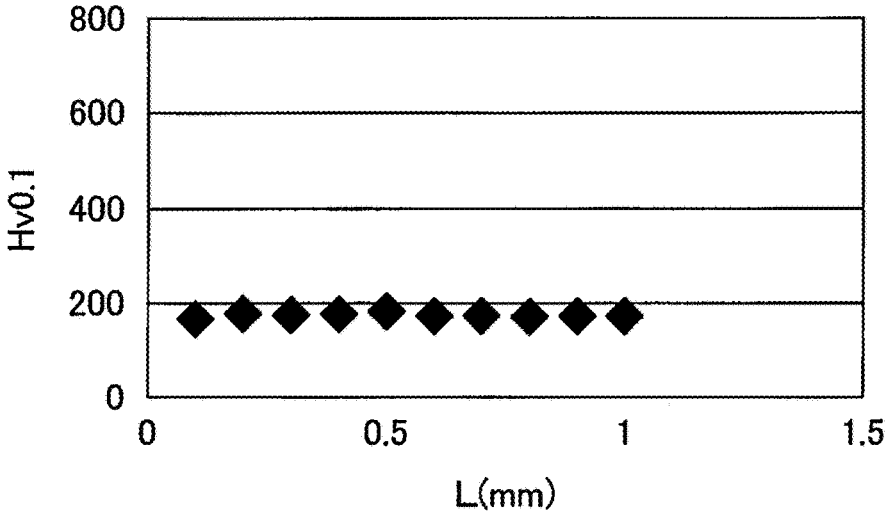
FIG. 8 is an illustrative diagram showing a relationship between a distance from the surface of a comparative product and Vickers hardness in Experimental Example 1.

A relationship between a distance L from the surface of the sample product and the comparative sample product and the Vickers hardness Hv 0.1 is examined. In the measurement of the Vickers hardness Hv, first, the disk-shaped ferritic stainless steel product 1 of the example product illustrated in FIG. 6A is cut so as to be bisected in the diameter direction to obtain a semi-disk-shaped test piece 10 illustrated in FIG. 6B. Thereafter, the test piece 10 is embedded in a resin (not shown), a cut surface 101 is polished, and then the Vickers hardness of the cutting surface 101 is measured. The measurement is performed at each predetermined distance in a direction from the surface of the test piece to the inside in the plate thickness direction, that is, in a direction of an arrow A in FIG. 6B. The same is applied to the measurement method of the comparative example product. A relationship between the distance L and the Vickers hardness Hv 0.1 of the example product is shown in FIG. 7, and a relationship between the distance L and the Vickers hardness Hv 0.1 of the comparative example product is shown in FIG. 8. Hv 0.1 is defined in accordance with JIS Z2244: 2009 and represents the Vickers hardness when the measured load by impression is set to 0.1 kgf, that is, 0.98 N.

As illustrated in FIG. 4A, in the example product produced by performing the nitriding step after the carburizing step, almost no discoloration to brown, brown, black, or the like caused by corrosion is observed. In contrast, discoloration is observed in the comparative example produced by performing the nitriding step without performing the carburizing step. The mottled portion in FIG. 4B is a discolored portion. Therefore, a ferritic stainless steel product having an excellent corrosion resistance can be obtained by performing the nitriding step after the carburizing step.

Further, as illustrated in FIG. 5A, in the example product produced by performing the nitriding step after the carburizing step, the martensite phase is formed to a sufficient depth from the surface by the martensitic transformation. Thus, as illustrated in FIG. 7, the example product exhibits a high hardness from the surface to a sufficiently deep position.

On the other hand, as illustrated in FIG. 5B, no martensite phase is observed in the comparative example product produced by performing the nitriding step without performing the carburizing step. As illustrated in FIG. 8, in the comparative example product, there is no increase in the surface hardness, and the hardness is low from the surface to the inside.

As described above, according to this example, the ferritic stainless steel product having both of the excellent corrosion resistance and the excellent hardness can be obtained by performing the nitriding step after the carburizing step.

(Experimental Example 2)

In this embodiment, a preferable relationship between a carbon concentration A mass % of the workpiece before forming the carburized layer, a surface carbon concentration $X_C$ mass % of the carburized layer after the carburizing step and before the nitriding step, a thickness $L_C$ mm of the carburized layer after the carburizing step and before the nitriding step, and a thickness $L_N$ mm of the carburized layer after the nitriding step is examined.

Figure 9:
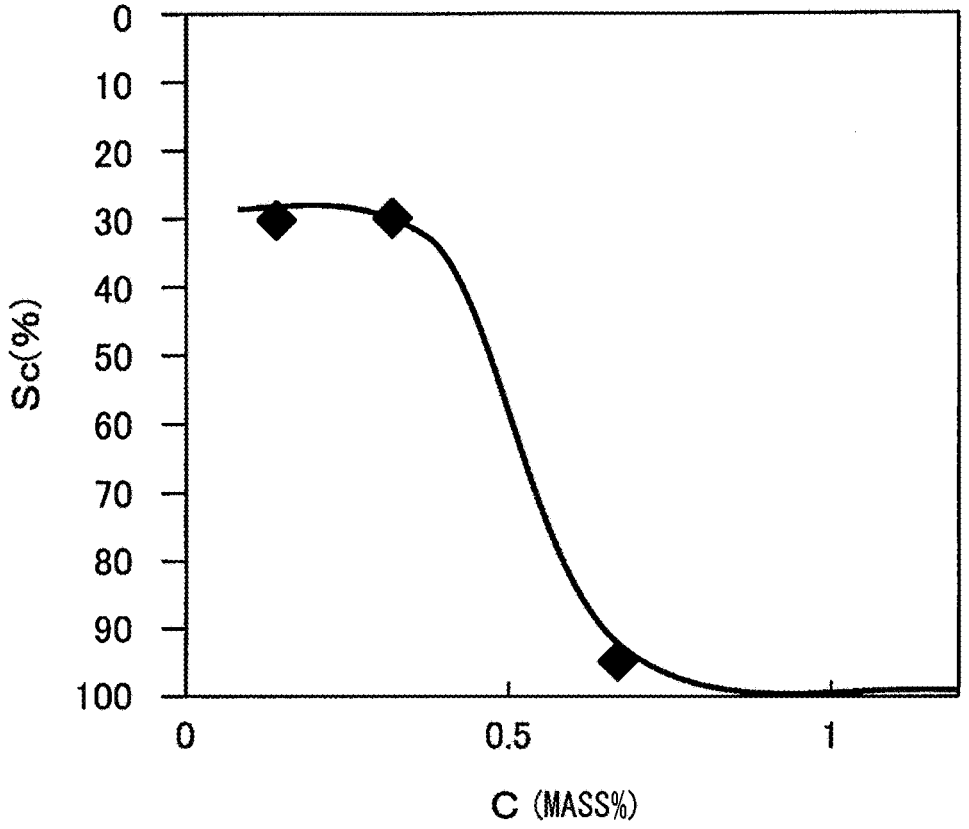
FIG. 9 is a diagram showing a relationship between a carbon content C mass % of a ferritic stainless steel material and an area percentage Sc % of a discolored portion after a corrosion resistance evaluation test in Experimental Example 2.

First, a relationship between the carbon concentration C (unit: mass %) of the ferritic stainless steel material and the corrosion resistance is examined. Specifically, the neutral salt spray test described above is performed. After the test, the surface of the material is observed, and an area ratio Sc of the discolored portion is measured. The discoloration portion is a corrosion portion. FIG. 9 shows a relationship between the carbon concentration C (unit: mass %) of the material and the area ratio Sc of the discolored portion.

As shown in FIG. 9, when the carbon concentration exceeds 0.3 mass %, the corrosion area increases remarkably and the corrosion resistance decreases remarkably. Therefore, from the viewpoint of securing the sufficient corrosion resistance, the carbon concentration is preferably 0.3 mass % or less.

Figure 10:
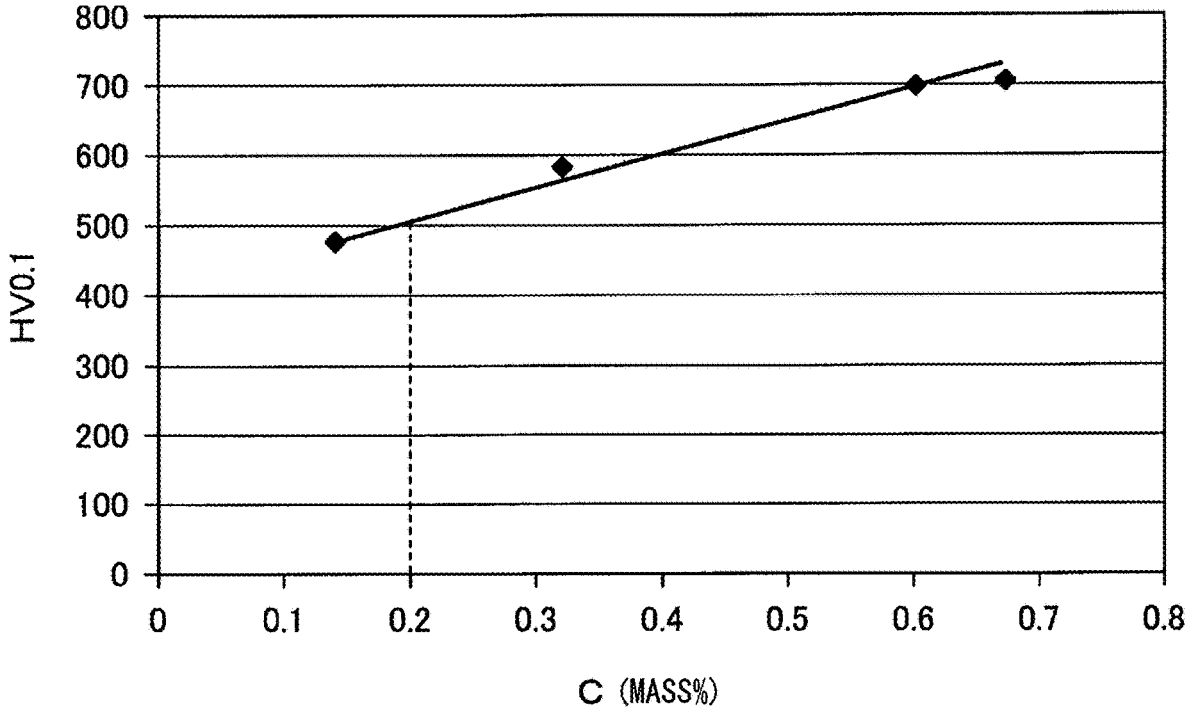
FIG. 10 is a diagram showing a relationship between a carbon content C mass % of the martensitic stainless steel material and Vickers hardness in Experimental Example 2.

FIG. 10 shows a relationship between the carbon concentration C (unit: mass %) of the ferritic stainless steel material and the Vickers hardness Hv 0.1. Specifically, multiple ferritic stainless steel materials having different carbon concentrations are prepared and processed into a disk shape. Next, a semi-disk-shaped test piece is produced from the disk-shaped test piece in the same manner as in Experimental Example 1, and the Vickers hardness is measured in the same manner as in Experimental Example 1. The results are shown in FIG. 10.

As shown in FIG. 10, the higher the carbon concentration C, the higher the Vickers hardness. In general, in order to secure the abrasion resistance, from the viewpoint that it is required to exceed 500 Hv 0.1, it is understood that the carbon concentration is preferably 0.2 mass % or more.

Next, in the process of performing the carburizing step and the nitriding step on the disk-shaped workpiece similar to the second embodiment, the C-concentration distribution of the workpiece is measured by an electron-beam microanalyzer (i.e., EPMA) under the following measuring device and measuring condition. As a sample for measuring the EPMA, the semi-disk-shaped sample obtained by diametrically cutting the disk-shaped sample in the diameter direction is used. Then, the C concentration distribution is measured by measuring the C concentration in the thickness direction of the semi-disk-shaped sample.

Measurement Device: EPMA 1610 manufactured by Shimadzu Manufacturing Co., Ltd.

ACC. V: 15 kV
Beam diameter: 3 μm
Beam current: 200 nA
Sampling pitch: 3 μm
Data Point: 400
Sampling time: 1 second The measurement is performed at a portion where the carburized layer is formed to a sufficient depth after each step of the carburizing step and the nitriding step. Specifically, first, the carbon concentration distribution of the workpiece obtained after performing the carburizing step in the same manner as in second embodiment is measured. Next, the carbon concentration distribution of the workpiece obtained by further performing the nitriding step after the carburizing step is measured. An example of the measurement is shown in FIG. 11.

Figure 11:
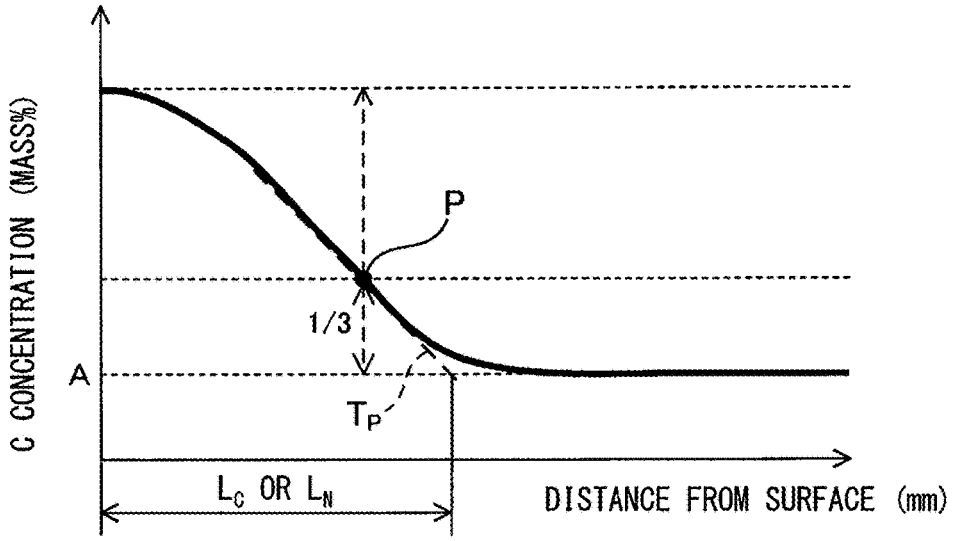
FIG. 11 is a diagram showing a carbon concentration distribution curve after a carburizing step or after a nitriding step in Experimental Example 2.

Although the carbon concentration distribution after the carburizing step and the carbon concentration distribution after the nitriding step have different carbon concentrations on the outermost surface, that is, different heights, and the shapes of the curves until convergence to a material carbon concentration A are different from each other, a distribution curve similar to that illustrated in FIG. 11 is drawn. The carbon concentration distribution is represented by a distribution curve in which an axis of abscissa represents a distance from the outermost surface of the workpiece (for example, a depth), and an axis of ordinate represents the carbon concentration. The axis of ordinate in FIG. 11 indicates the carbon concentration after the carburizing step or the carbon concentration after the nitriding step.

In the carbon concentration distribution after the carburizing step and before the nitriding step, a mean value of the carbon concentration at a position corresponding to 10 points of the beam diameter from the outermost surface, that is, at a position 30 μm from the outermost surface is defined as a surface carbon concentration $X_C$.

Further, as illustrated in FIG. 11, in the carbon concentration distribution curve in the workpiece after the carburizing step, a distance to an intersection between a tangent $T_p$ at a reference point P at which the carbon concentration is ⅓ of the outermost surface and the material carbon concentration A is defined as the thickness $L_C$ of the carburized layer after the carburizing step and before the nitriding step.

Further, as illustrated in FIG. 11, in the carbon concentration distribution curve in the workpiece after the nitriding step, a distance to the intersection between the tangent Tp at the reference point P at which the carbon concentration is ⅓ of the outermost surface and the material carbon concentration A is defined as the thickness $L_N$ of the carburized layer after the nitriding step.

In addition, the material carbon concentration A of the workpiece is an original carbon concentration of the ferritic stainless steel material of the workpiece before the above-mentioned carburizing step or nitriding step is performed.

Figure 12:
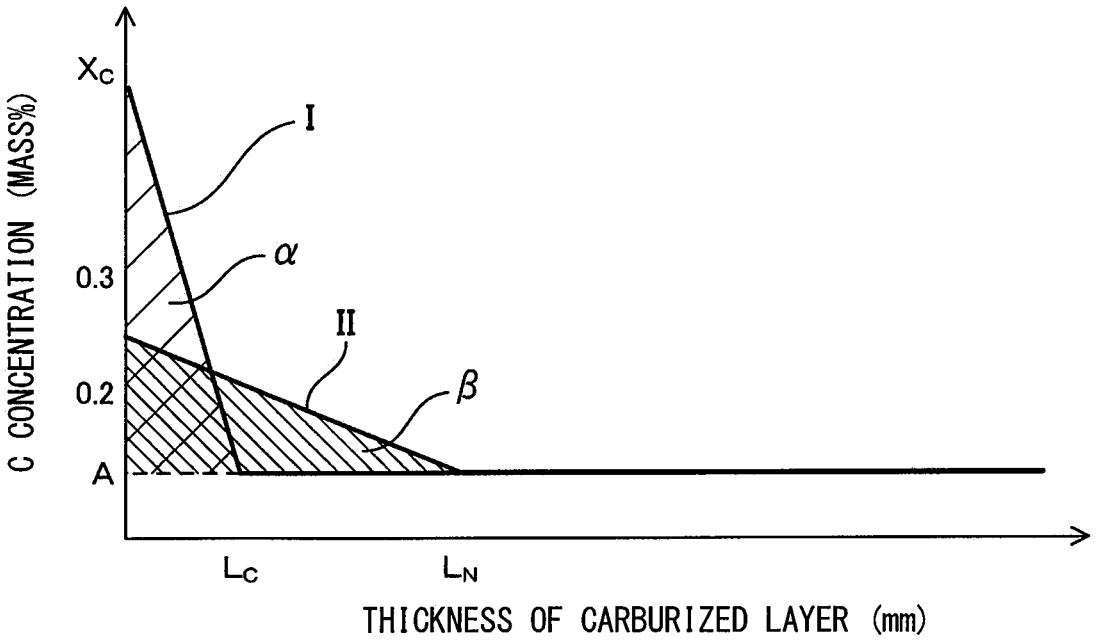
FIG. 12 is a diagram showing a graph I of a relationship between a thickness of a carburized layer and the carbon concentration after the carburizing step and a graph II of a relationship between a thickness of the carburized layer and the carbon concentration after the nitriding step in Experimental Example 2.

A relationship between the thickness of the carburized layer after the carburizing step (that is, the depth of carburizing) and the carbon concentration is shown in a diagram I, and a relationship between the thickness of the carburized layer diffused inside after the nitriding step and the carbon concentration is also shown in a diagram II in FIG. 12. The diagrams I and II in FIG. 12 show linear approximations of carbon concentration distribution curves.

In this example, the amount of carbon taken into the workpiece after the carburizing step is represented by a hatched area α in FIG. 12, and the amount of carbon in the workpiece after the nitriding step is represented by a hatched region β. In the nitriding step, since carbon taken in the carburizing step is diffused inside, the outermost surface carbon concentration after the nitriding step is lower than that after the carburizing step, but the amount of carbon itself in the workpiece is not changed. That is, an area of the hatched region α and an area of the hatched region β in the workpiece are the same.

Figure 13:
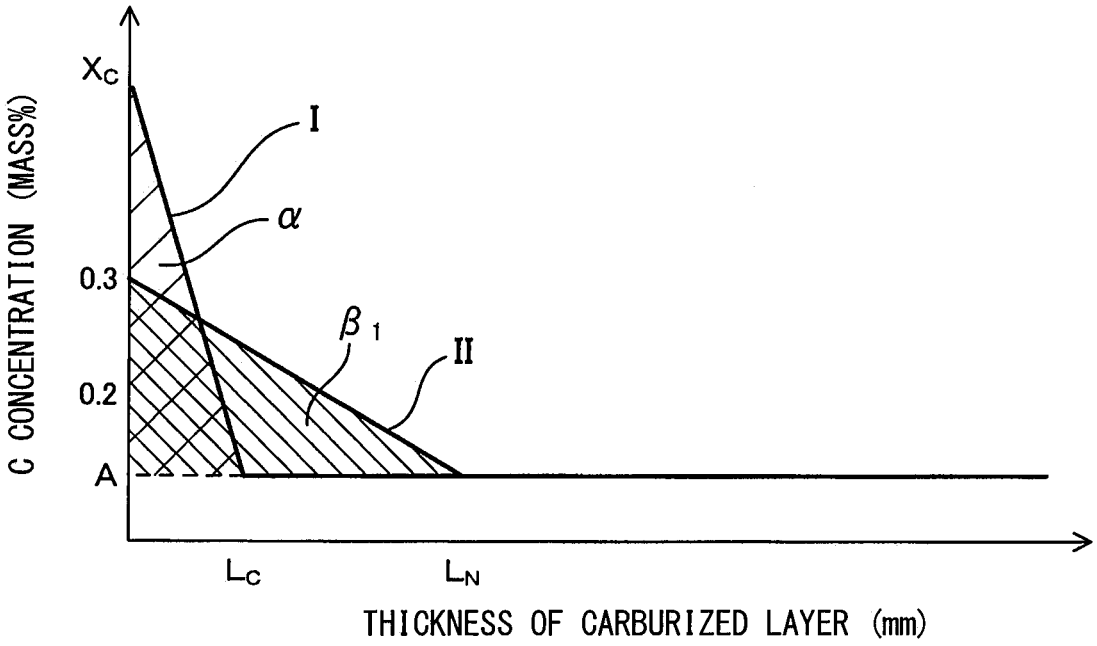
FIG. 13 is a diagram showing a graph I of a relationship between a thickness of a carburized layer and the carbon concentration after the carburizing step and a graph II of a relationship between a thickness of the carburized layer and the carbon concentration when an outermost surface carbon concentration becomes 0.3 mass % after the nitriding step in Experimental Example 2.

Assuming that the surface carbon concentration of the workpiece after the nitriding step becomes 0.3 mass %, the carbon amount present in the workpiece in the nitriding step is represented by a hatched region $\beta_1$ in FIG. 13. In order to sufficiently enhance the corrosion resistance, as described above, from the standpoint that the surface carbon concentration of the workpiece after the nitriding step is preferably 0.3 mass % or less, in FIG. 13, the area of the region α is preferably equal to or less than the area of the region $\beta_1$.

In other words, $(X_C-A)\times L_C\times 1/2 \leq (0.3-A)\times L_N\times 1/2$ is preferable. This is synonymous with the preference for $(X_C-A)\times L_C \leq (0.3-A)\times L_N$. Therefore, in order to obtain a ferritic stainless steel product excellent in corrosion resistance, $(X_C-A)\times L_C \leq (0.3-A)\times L_N$ is preferable.

Figure 14:
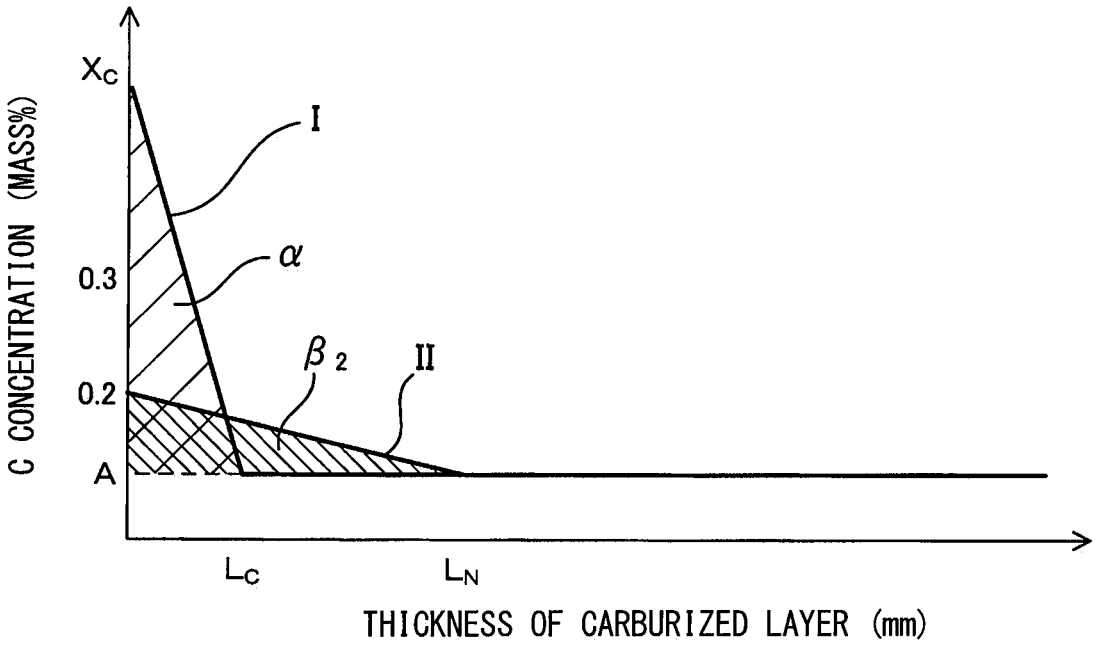
FIG. 14 is a diagram showing a graph I of a relationship between a thickness of a carburized layer and the carbon concentration after the carburizing step and a graph II of a relationship between a thickness of the carburized layer and the carbon concentration when an outermost surface carbon concentration becomes 0.2 mass % after the nitriding step in Experimental Example 2.

Assuming that the surface carbon concentration of the workpiece after the nitriding step becomes 0.2 mass %, the carbon amount present in the workpiece in the nitriding step is represented by a hatched region $\beta_2$ in FIG. 14. In order to form the nitrided layer more stably, as described above, from the viewpoint that the surface carbon concentration of the workpiece after the nitriding step is preferably 0.2 mass % or more, in FIG. 14, the area of the region α is preferably equal to or less than the area of the region $\beta_1$.

In other words, $(0.2-A)\times L_N\times 1/2 \leq (X_C-A)\times L_C\times 1/2$ is preferable. This is synonymous with the preference for $(0.2-A)\times L_N \leq (X_C-A)\times L_C$. Therefore, in order to form the nitrided layer more stably to obtain a ferritic stainless steel product having higher hardness, $(0.2-A)\times L_N \leq (X_C-A)\times L_C$ is preferable.

The various conditions can be adjusted so that the material carbon concentration A mass %, the surface carbon concentration $X_C$ mass % of the carburized layer after the carburizing step and before the nitriding step, the thickness $L_C$ mm of the carburized layer after the carburizing step and before the nitriding step, and the thickness $L_N$ mm of the carburized layer after the nitriding step satisfy the above-mentioned preferable relationship. That is, the carburizing temperature and the carburizing time in the carburizing step, the nitriding temperature and the nitriding time in the nitriding step, and the like can be controlled so as to satisfy the desired relationships described above. This makes it possible to obtain a ferritic stainless steel product having superior corrosion resistance and hardness.

Although the present disclosure is described based on the above embodiments, the present disclosure is not limited to the embodiments and the structures. Various changes and modification may be made in the present disclosure. Furthermore, various combination and formation, and other combination and formation including one, more than one or less than one element may be made in the present disclosure.

Optional aspects of the present disclosure will be set forth in the following clauses.

According to an aspect of the present disclosure, a method for manufacturing a ferritic stainless steel product includes: forming a carburized layer on a workpiece made of ferritic stainless steel; and forming a nitrided layer on a surface of the workpiece by heating the workpiece at a temperature equal to or higher than a transformation point of the ferritic stainless steel in an atmosphere containing an $N_2$ gas after forming the carburized layer.

According to the aspect of the present disclosure, after the carburized layer is formed on the workpiece, the nitrided layer is formed. For that reason, even if the carbon concentration of the workpiece is low, the carbon concentration of the workpiece can be increased when the carburized layer is formed, so that the nitrided layer can be sufficiently formed when the nitrided layer is formed.

In addition, since the passive film existing on the surface of the ferritic stainless steel can be broken by the formation of the carburized layer, nitrogen easily dissolves in the ferritic stainless steel in the formation of the nitrided layer. For that reason, the nitrided layer can be sufficiently formed, and the nitrided layer can be formed from the surface of the workpiece to a sufficiently deep portion.

The nitrided layer can undergo a martensitic transformation, for example by cooling. As a result, a martensite phase having a high hardness can be formed. Therefore, according to the aspect of the present disclosure, a ferritic stainless steel product having a high hardness can be manufactured.

In forming the nitrided layer, heating is performed at a high temperature of not less than the transformation point temperature of the ferritic stainless steel after the carburized layer has been formed. For that reason, when the nitrided layer is formed, carbon atoms in the carburized layer can be diffused into the interior of the workpiece. That is, in forming the nitrided layer, not only the solid solution of nitrogen into the carburized layer and the formation of the nitrided layer but also the diffusion of carbon atoms can lower the surface carbon concentration of the workpiece. This decrease in the surface carbon concentration improves the corrosion resistance. In other words, the hardness can be improved without lowering the corrosion resistance. That is, a ferritic stainless steel product having excellent hardness and corrosion resistance can be manufactured.

According to the aspect of the present disclosure described above, a method for manufacturing a ferritic stainless steel product capable of forming a nitrided layer and improving hardness regardless of a carbon concentration of a material can be provided.

What is claimed is:

1. A method for manufacturing a ferritic stainless steel product, the method comprising:

forming a carburized layer on a workpiece made of ferritic stainless steel; and forming a nitrided layer on a surface of the workpiece by heating the workpiece at a temperature equal to or higher than a transformation point of the ferritic stainless steel in an atmosphere containing an $N_2$ gas, wherein a carbon concentration defined by A mass % of the workpiece before forming the carburized layer, a surface carbon concentration defined by $X_C$ mass % of the carburized layer and a thickness defined by $L_C$ millimeters (mm) of the carburized layer after forming the carburized layer and before forming the nitrided layer, and a thickness defined by $L_N$ mm of the carburized layer after forming the nitrided layer satisfy a relationship of $(X_C-A)\times L_C \leq (0.3-A)\times L_N$.

2. The method for manufacturing the ferritic stainless steel product according to claim 1, the method further comprising cooling the workpiece by quenching the workpiece having the nitrided layer.

3. The method for manufacturing the ferritic stainless steel product according to claim 1, wherein the carbon concentration defined by A mass % of the workpiece before forming the carburized layer, the surface carbon concentration defined by $X_C$ mass % of the carburized layer and the thickness defined by $L_C$ mm of the carburized layer after forming the carburized layer and before forming the nitrided layer, and the thickness defined by $L_N$ mm of the carburized layer after forming the nitrided layer satisfy a relationship of $(0.2-A)\times L_N \leq (X_C-A)\times L_C$.

4. The method for manufacturing the ferritic stainless steel product according to claim 1, wherein the forming the carburized layer includes:

heating an interior of a heating furnace in which the workpiece is disposed under a reduced pressure condition up to a carburizing temperature; and supplying a carburizing gas into the heating furnace.

5. The method for manufacturing the ferritic stainless steel product according to claim 4, wherein the carburizing gas contains at least an unsaturated hydrocarbon gas.

* * * * *